US006209586B1

(12) United States Patent
Wright

(10) Patent No.: US 6,209,586 B1
(45) Date of Patent: Apr. 3, 2001

(54) AGGREGATE RETAINING DEVICE FOR DRAIN COVERS

(76) Inventor: James R. Wright, 1783 Cedar Glenn St., Unit C, Anaheim, CA (US) 92807

( * ) Notice: Subject to any disclaimer, the term of this patent is extended or adjusted under 35 U.S.C. 154(b) by 0 days.

(21) Appl. No.: 09/452,766

(22) Filed: Dec. 1, 1999

(51) Int. Cl.[7] ..... E04H 4/14
(52) U.S. Cl. ..... 138/96 R; 4/504; 4/507
(58) Field of Search ..... 138/96 R, 90; 4/496, 504, 507, 506; 210/162, 163

(56) References Cited

U.S. PATENT DOCUMENTS

D. 333,342 * 2/1993 Newhard ..... 4/507
D. 351,220 * 10/1994 Barnes ..... D23/260
3,378,858 * 4/1968 Jacuzzi ..... 4/507 X
3,800,486 * 4/1974 Harvey ..... 138/96 R X
3,829,910 * 8/1974 Kaufman ..... 4/504
4,170,047 * 10/1979 Corsette et al. ..... 4/293
4,658,449 * 4/1987 Martin ..... 4/496
4,666,333 * 5/1987 Armstrong ..... 404/26
4,957,268 * 9/1990 Picollo et al. ..... 249/10
5,003,735 * 4/1991 Bates ..... 138/96 R X
5,268,096 * 12/1993 Robol ..... 210/164
5,341,523 * 8/1994 Barnes ..... 4/507
5,360,284 * 11/1994 Allard ..... 404/2
5,734,999 * 4/1998 Nicholas ..... 4/507
5,996,134 * 12/1999 Senninger ..... 138/96 R X

* cited by examiner

*Primary Examiner*—Patrick Brinson
(74) *Attorney, Agent, or Firm*—Knobbe, Martens, Olson & Bear, LLP

(57) ABSTRACT

An apparatus for and a method of forming a surface finish on a top surface of a drain cover for swimming pools or spas so that the surface finish of the drain cover matches the surface finish of the pool or spa. The apparatus comprises a ring shaped structure that is adapted to be positioned on the top surface of the drain cover wherein the ring is mounted along the general outer perimeter of the top surface of the drain cover. An exposed aggregate or plaster finish is then formed on the top surface of the cover enclosed by the ring so that the ring retains and shapes the surface finish.

20 Claims, 4 Drawing Sheets

AGGREGATE RETAINING DEVICE FOR DRAIN COVERS

BACKGROUND OF THE INVENTION

1. Field of the Invention

This invention relates to drain covers for swimming pools and spas, and more particularly to an apparatus for applying an exposed aggregate or plaster finish to the top surface of drain covers.

2. Description of the Related Art

Drain openings are typically formed on the bottom of most conventional swimming pools so that water can be removed from the pool and circulated through a filtration system. The openings generally extend through the floor of the pool and are connected to drain pipes that are configured to transport water from the pool to a filtering device. Furthermore, a recirculation pump is typically used to remove water from the pool through the drains, down the drain pipes, and into the filtration system wherein the water is filtered and cleaned before being transported back into the pool through the return lines.

Disadvantageously, however, the drain openings are generally unsightly and can pose as a safety hazard for swimmers. In particular, the suction created by the large volume of water passing through the drains is known to cause a whirlpool vortex wherein the force of the vortex can be strong enough to pull down and trap swimmers near the drains. Furthermore, it can be appreciated that a swimming pool tends to lose some of its aesthetic appeal when the floor of the pool is dotted with numerous drain openings. To address these problems, various anti-vortex drains and covers have been developed to reduce the suction around the drains while at the same time enhance the aesthetic appeal of the pool.

In particular, the standard drain cover currently used for most swimming pools is a circular anti-vortex drain cover. The cover is adapted to be positioned over a generally circular drain opening and comprises a top surface that is relatively flat and a plurality of side openings that serve as passage ways for water to flow from the pool into the drain opening. Furthermore, the cover is made from plastic material and is generally available only in a limited number of colors such as black, white, and shades of gray.

Consequently, the standard drain covers often do not match the surface finish of the swimming pool as the surface finish of the pools can be made from a wide variety of colors and textures. In particular, the standard drain covers will appear conspicuously out of place when set against the surface finish of swimming pools having a plaster or exposed aggregate finish wherein the color of the surface is custom blended to the taste of the pool owner. Likewise, the standard drain covers also appear undesirably conspicuous when they are positioned over drain openings formed on the bottom of spas that are decorated with a colored plaster or exposed aggregate finish.

To address this problem, drain cover assemblies have been created that are designed with the intent of making the cover less conspicuous and more uniform with the surface finish of the pool or spa. In particular, there are existing covers made from a clear plastic material wherein the transparency of the plastic is likely to make the cover less noticeable and allow the cover to blend in with the surface finish of the pool or spa. Disadvantageously, however, the transparent covers do not properly conceal the drain pipes underneath the covers and therefore leave the unsightly pipes exposed to plain view. It can be appreciated that visible drain pipes on the bottom of a swimming pool or spa are sometimes even more unappealing than drain covers that do not match the color and texture of the surface finish of the pool.

Hence, from the foregoing, it will be appreciated that there is a need for a drain cover for swimming pools or spas that is less conspicuous. To this end, there is a particular need for an apparatus or a method for matching a drain cover to the surrounding surface.

SUMMARY OF THE INVENTION

The aforementioned needs are satisfied by the apparatus for forming an exposed aggregate or plaster surface finish on drain covers of the present invention. In one aspect, the apparatus of the present invention comprises an aggregate retaining member wherein the retaining member is positioned adjacent an upper surface of a pool drain cover such that the retaining member retains aggregate material on the upper surface of the pool drain cover. Preferably, the retaining member is attached to the drain cover through the use of fasteners or screws. Preferably, the retaining member extends about an outer perimeter of the upper surface of the drain cover so as to define a cavity in which the aggregate material can be positioned and wherein the retaining member exerts a force against the aggregate material to retain the aggregate material in the cavity adjacent the upper surface.

In another embodiment, the retaining member extends outward from the plane of the upper surface while simultaneously extending inward towards the center of the upper surface of the drain cover such that an outer edge of the retaining member is positioned over the plane of the upper surface. Preferably, the retaining member is formed of a clear material so that the aggregate material is visible through the retaining member to thereby camouflage the retaining member.

Furthermore, the retaining member comprises at least one reinforcing member that extends across the cavity defined by the retaining member wherein the at least one reinforcing member is coupled to the inner walls of the retaining member so as to increase the structural rigidity of the retaining member. Preferably, the at least one reinforcing member is recessed in the cavity so as to be located a distance less than the first distance from the upper surface so that when the aggregate material is positioned within the cavity, the aggregate material covers the at least one reinforcing member.

In another embodiment, the present invention comprises a pool drain cover assembly wherein the assembly comprises a base member, a cap member, and an retainer positioned adjacent an upper surface of the cap member so as to form a cavity on the upper surface wherein aggregate material is retained in the cavity on the upper surface of the cap member. Preferably the aggregate material is positioned within the cavity so as to be in contact with the upper surface of the cap member and the inner surfaces of the retainer.

In one embodiment, the pool drain cover assembly can be formed by attaching the base member, cap member, and retainer together through the use of fasteners. In another embodiment, the retainer can be molded as an integral part of the cap member. Preferably, the upper surface of the drain cover is coated with an exposed aggregate material that is substantially identical to the surface finish of the swimming pool. In particular, the retaining member retains the aggregate on the upper surface of the cap member so as to make the aggregate appear as the color and texture of the cover assembly. In contrast to the conventional drain covers that are available in only a selected number of colors, the pool drain cover assembly of the present invention can be easily made into a wide variety of colors and textures to match the surface finish of the swimming pool. Advantageously, the drain cover assembly is camouflaged in the same color and texture as the swimming pool so as to not detract from the aesthetic appeal of the pool.

DETAILED DESCRIPTION OF THE PREFERRED EMBODIMENT

Reference will now be made to the drawings wherein like numerals refer to like parts throughout. As will be described hereinbelow, the apparatus of the preferred embodiment provides a means of applying a plaster or exposed aggregate surface finish onto a top surface of a drain cover for swimming pools or spas.

Figure 1:
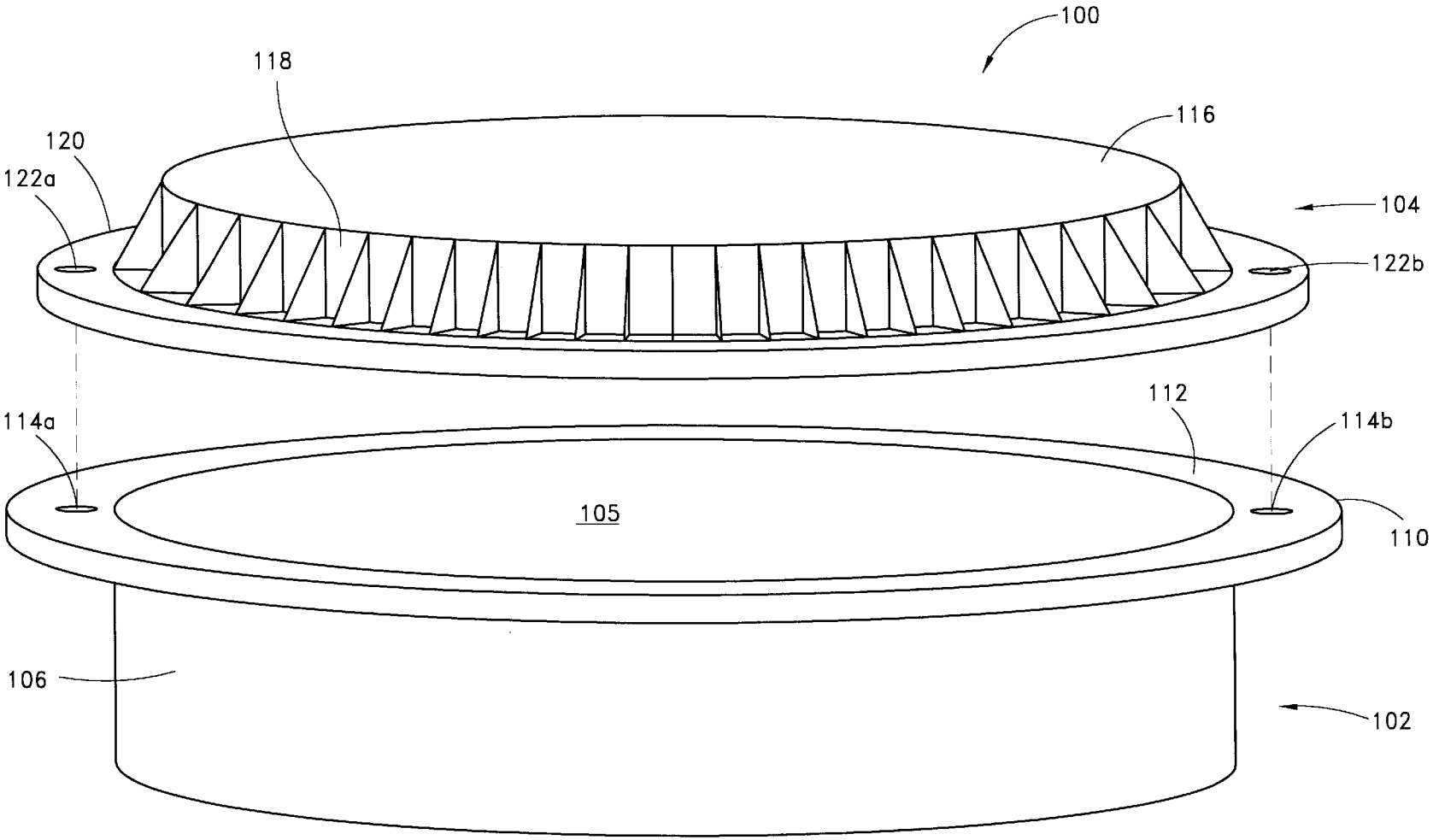
FIG. 1 is a general perspective view of one embodiment of a conventional drain cover assembly for swimming pools and spas.

FIG. 1 shows an embodiment of a conventional anti-vortex drain cover assembly 100 that is commonly used to cover drain openings of swimming pools and spas. As FIG. 1 illustrates, the drain cover assembly 100 is generally circular in shape and comprises a base 102 and a cap 104 wherein the cap 104 is mounted onto the base 102 in a well known manner. Furthermore, the base 102 is generally ring-shaped and comprises a side wall 106 defining an outer perimeter of the base 102. The base member 102 also defines a central opening 105. The side walls 106 of the base member 102 are typically positioned within a drain opening in the pool or spa such that water can flow through the central opening 105 into the drain.

Preferably, a lip 110 extends perpendicularly outward from an upper edge of the side wall 106 so as to create a mounting surface 112 for the cap 104. Furthermore, a plurality of first openings 114*a*, 114*b* are formed on the mounting surface 112 wherein the openings 114*a*, 114*b* are configured to receive a plurality of mounting screws that are typically used to affix the cap 104 to the base 102.

As FIG. 1 further illustrates, the cap 104 of the cover assembly 100 is also generally circular in shape and comprises an upper surface 116, a bottom rim 120, and a plurality of side openings 118 designed for water to pass through. In particular, the bottom rim 120 of the cap 104 is adapted to rest on the mounting surface 112 of the base 102 when the cap 104 is mounted to the base 102. Furthermore, the bottom rim 120 comprises a plurality of second openings 122*a*, 122*b* that are configured to align with the corresponding first openings 114*a*, 114*b* on the mounting surface 112 so that a mounting screw or other fastener can be inserted into each pair of aligned openings so as to secure the top cover 104 onto the base 102.

In one embodiment, the cover assembly 100 can be installed over a drain opening by positioning the ring-like base 102 around the drain in a manner such that the side wall 106 of the base 102 is completely imbedded in the surrounding concrete while the lip 110 of the base 102 remains above ground and encircles the drain opening. Preferably, the cap 104 is then mounted onto the base 102 via screws or other types of fasteners so that the drain opening is effectively concealed by the cap 104 while water from the pool is directed to flow through the side openings 118 of the cap 104 and down the drain.

Typically, the upper surface 116 of the cover is open to plain view when the cover assembly 100 is installed in a pool. It is therefore desirable to select drain covers with colors that substantially match the surface finish of the pool in order to preserve the overall aesthetic appeal of the pool. However, drain cover assemblies known in the art are typically available in only a limited number of colors such as black, white, or gray. Consequently, drain covers installed in most swimming pools do not match the surface finish of the pool as it is economically impractical to paint each drain cover in a color that matches the surface finish of a particular pool. Moreover, the standard drain covers are known to appear especially out of place when installed in swimming pools having an exposed aggregate finish wherein the color of the aggregate is custom blended.

As will be described in greater detail below, the drain cover of the illustrated embodiment provides a novel apparatus for and method of eliminating the color mismatch between the drain covers and the surface finish of swimming pools. In particular, the preferred embodiment provides an aggregate retaining device wherein the device is mounted on the drain cover and enables the top surface of the drain cover to be coated with a plaster or an exposed aggregate finish wherein the color and texture of the finish is substantially identical to the particular surface finish of the pool. In contrast to the conventional drain covers known in the art, the present invention provides a drain cover that is camouflaged in substantially the same color and texture as the surface finish of the swimming pool or spa so as to enhance the aesthetic appeal of the pool or spa.

Figure 2:
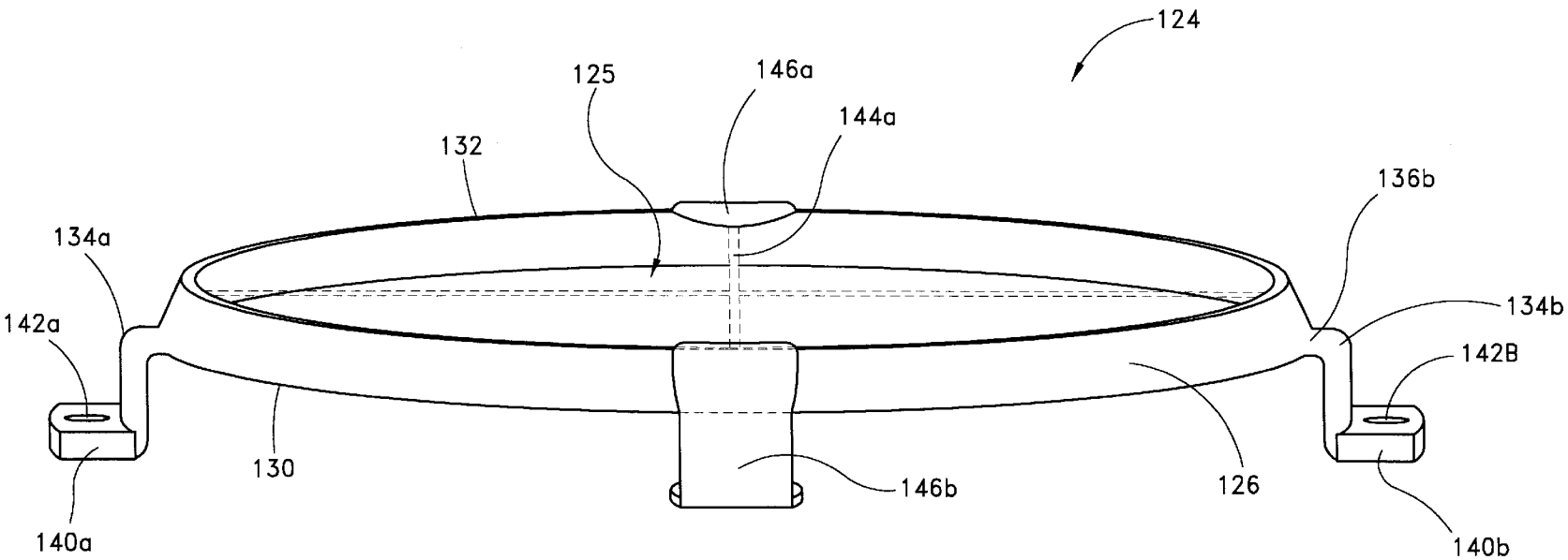
FIG. 2 is a general perspective view of one embodiment of an aggregate retaining device of the present invention.

With reference to FIG. 2, a perspective view of an aggregate retaining device 124 of the preferred embodiment is shown. As is illustrated in FIG. 2, the aggregate retaining device 124 is a generally ring shaped structure that is mounted adjacent the upper surface 116 of the drain cover 100 in a manner to be described in greater detail below. Preferably, the device 124 comprises a sidewall 126 wherein the sidewall 126 defines a generally circular opening 125. Furthermore, the device 124 is dimensioned so that its sidewall 126 is mounted adjacent the outer perimeter of the upper surface 116 of the drain cover 100 and extend upward from the plane of the upper surface 116 so as to form a cavity adjacent the upper surface 116. As will be described in greater detail below, the cavity is subsequently filled with an aggregate material wherein the aggregate material is retained within the cavity by the side wall 126.

As FIG. 2 further illustrates, the side wall 126 of the retaining device 124 is also configured to slope inwardly toward the center of the opening 125 as it extends outward from the plane of the upper surface 116. The inwardly sloped side wall 126 is more effective in mechanically retaining the aggregate and preventing the aggregate from being displaced. While the preferred embodiment describes a generally circular aggregate retaining device, the device can assume a variety of other shapes without departing from the scope of the invention.

As is also shown in FIG. 2, the retaining device 124 further comprises a plurality of mounting brackets 134*a*, 134*b* wherein each bracket is a generally Z-shaped structure that is dimensioned to affix the retaining device 124 to the cover assembly 100. In particular, a first end 136*a*, 136*b* of the bracket 134*a*, 134*b* is attached to the side wall 126 while a second end 140*a*, 140*b* of the device 124 is configured to rest on the rim 120 of the cover assembly 100. Preferably, the second end 140*a*, 140*b* is a positioned horizontally over the second opening 122*a*, 122*b* on the rim 120 of the cap 104 so that a third opening 142*a*, 142*b* formed on the second end 140*a*, 140*b* of the bracket 134*a*, 134*b* aligns with the second opening 122*a*, 122*b* on the rim 120 of the cover assembly 100. Preferably, a mounting screw or fastener is inserted into the aligned openings so as to secure the retaining device 124 onto the cover assembly 100. Advantageously, the aggregate retaining device 124 can be easily mounted onto a conventional standard drain cover by utilizing existing mounting holes on the cover. However, it can be appreciated that different types of fastening devices can be used to mount the aggregate retaining device 124 onto the cover assembly 100 in other embodiments of the present invention.

As FIG. 2 further shows, a plurality of reinforcing members 144*a*, 144*b* is positioned across the opening 125 of the aggregate retaining device 124 so as to provide structural support in a manner to be described in greater detail below. FIG. 2 shows each reinforcing member 144*a*, 144*b* extending across a diameter of the opening 125 in a manner so as to form a generally cross-shaped configuration. Furthermore, the plane defined by the reinforcing members 144*a*, 144*b* is slightly recessed from the plane defined by the top edge of the aggregate retaining device 124. Preferably, the reinforcing members 144*a*, 144*b* are designed to rest in the aggregate material inside the cavity defined by the opening 125 so as to mechanically reinforce the aggregate material such that people standing on the drain in the pool are less likely to damage or crack the aggregate material.

Furthermore, a plurality of clips 146*a*, 146*b* are formed in a well known manner on the bottom surface 130 of the retaining device 124 wherein the clips 146*a*, 146*b* are designed to engage an outer edge 138 of the top surface of the cover assembly 100 so as to further secure the retaining device 124 onto the cover assembly 100. While the aggregate retaining device 124 of the preferred embodiment is adapted for an anti-vortex drain cover, it can be appreciated that the retaining device 124 can be configured for a wide variety of other types of drain covers without departing from the scope of the invention.

Figure 3:
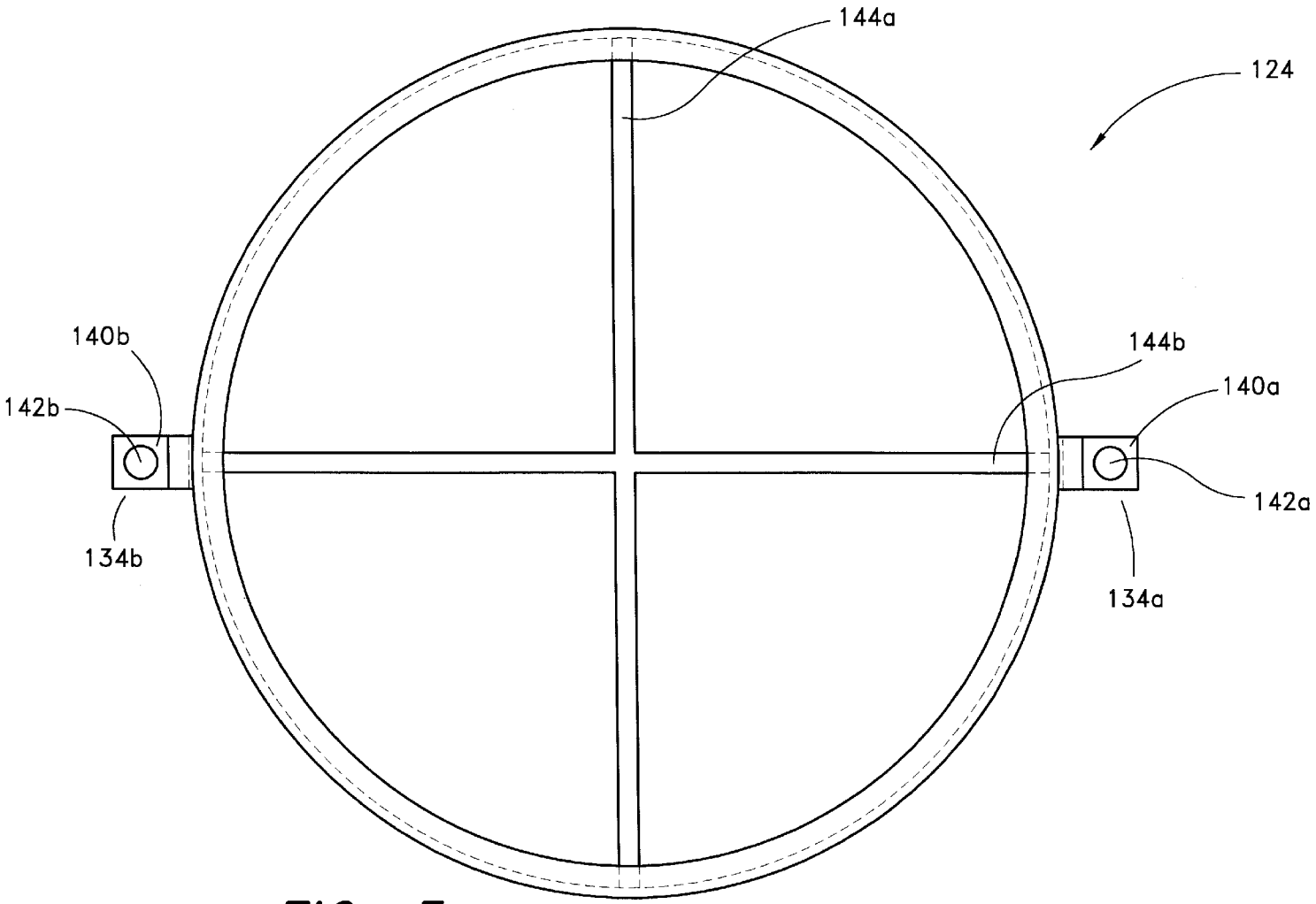
FIG. 3 is a top down view of the aggregate retaining device of FIG. 2.

FIG. 3 illustrates a top down view of the above described aggregate retaining device 124. As FIG. 3 illustrates, the aggregate retaining device 124 of the illustrated embodiment is generally circular in shape and comprises two mounting brackets 134*a*, 134*b* that are attached to the outer surface of the retaining device 124 and positioned diametrically across from each other. Furthermore, FIG. 3 shows the second end 140*a*, 140*b* of the device having the openings 142*a*, 142*b* configured for mounting screws.

Figure 4:
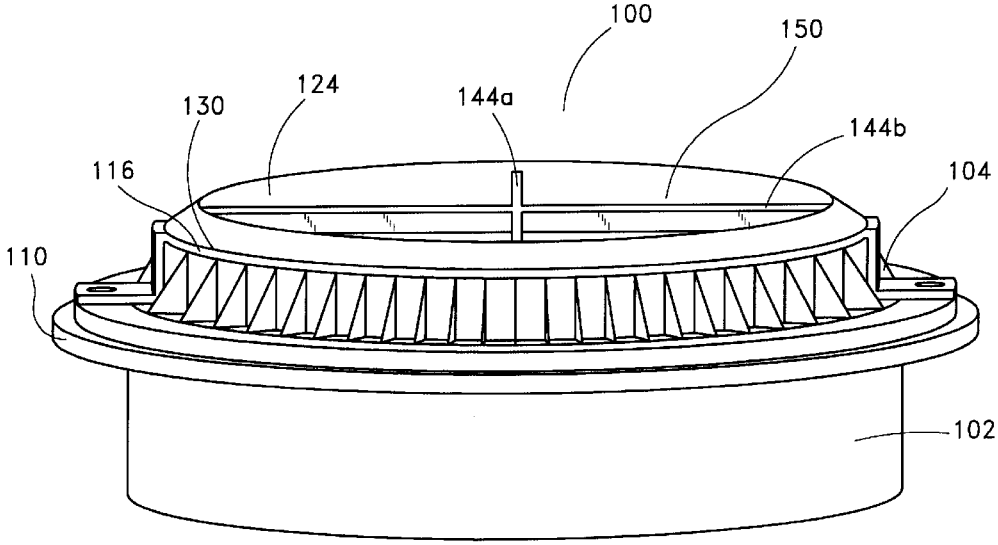
FIG. 4 is a general perspective view of the aggregate retaining device of FIG. 2 mounted on the drain cover assembly of FIG. 1.

FIG. 4 illustrates a general perspective view of the above described aggregate retaining device 124 mounted on the drain cover assembly 100 of the preferred embodiment. As is shown in FIG. 4, the bottom surface 130 of the retaining device 124 rests adjacent the outer perimeter of the upper surface 116 of the cover assembly 100 so as to define a cavity 150 that will be filled with aggregate material. Preferably, the device 124 is fixedly attached to the cover assembly 100 via mounting screws or fasteners as described in detail above. As it is shown above, the aggregate retaining device 124 is simple to implement as it is designed to utilize existing parts on a standard drain cover and does not require additional tools or processing. While the device of the present invention is adaptable to any drain cover having a general top surface, the device can also be made as an integral part of a drain cover assembly in other embodiments of the invention.

Figure 5:
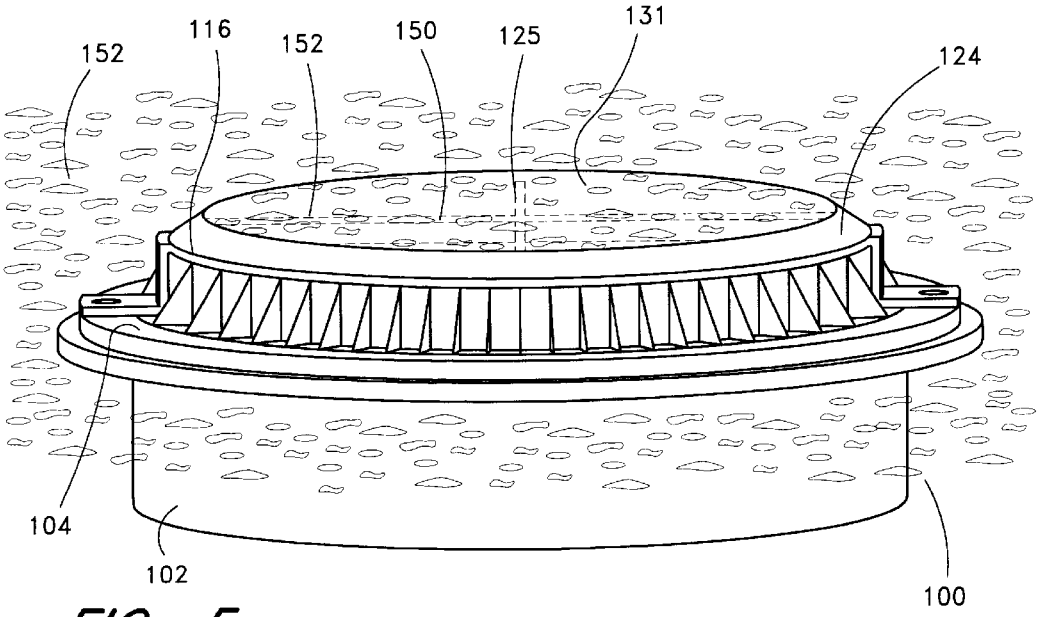
FIG. 5 is the drain cover assembly of FIG. 4 wherein an exposed aggregate surface is formed on a top surface of the drain cover.

FIG. 5 shows the drain cover assembly 100 of the present invention wherein its top surface is coated with a plaster or aggregate finish. As is shown in FIG. 5, an aggregate material is filled into the cavity 150 created by the retaining device 124, using tools and techniques that are well known in the art. In particular, the aggregate material used is substantially identical to the surface finish 152 of the pool. As is shown in FIG. 5, the top surface of the cover assembly is thus made to resemble the pool surface in color and texture.

The aggregate retaining device 124 retains the aggregate material as a result of the aggregate material being positioned adjacent the upper surface 116 of the cover 104 and the outer perimeter of the aggregate material being positioned underneath the inner surfaces 131 of the ring 124. As discussed above, the inner surfaces 131 of the ring 124 are preferably angled inward towards the center of the opening 125. Hence the inner surfaces 131 exert a downward force against the outer perimeter of the aggregate material 152. When the aggregate material 152 dries in the cavity 150, the bonding between the aggregate material results in the aggregate material being essentially a solid mass. Since the outer perimeter of the aggregate material 152 is captured by the inner surfaces 131 of the ring 124 against the upper surface 116 of the cover 104, the aggregate material 152 is retained adjacent the upper surface 116 of the cover 104.

In one embodiment, the cover assembly 100 and the aggregate retaining device are made from a clear plastic material such as polycarbonate. The clear material camouflages the aggregate retaining device 124 so that only the aggregate surface of the cover is visible. As FIG. 5 illustrates, the drain cover 100 with an aggregate finish on the top is not conspicuous and conform with the surface finish of the pool. Furthermore, the device provides a convenient way for the user to apply the aggregate surface so that the drain covers can be made to any type of plaster or exposed aggregate finish.

Although the foregoing description of the preferred embodiment of the present invention has shown, described and pointed out the fundamental novel features of the invention, it will be understood that various omissions, substitutions, and changes in the form of the detail of the apparatus as illustrated as well as the uses thereof, may be made by those skilled in the art, without departing from the spirit of the invention. Consequently, the scope of the invention should not be limited to the foregoing discussions, but should be defined by the appended claims.

What is claimed is:

1. A pool drain member adapted to be positioned over an drain opening in a pool wherein the pool drain member includes an upper surface and at least one side surface wherein the at least one side surface includes at least one opening permitting fluid communication therethrough to the drain opening and wherein pool drain member includes a retaining member positioned adjacent the upper surface of the pool drain member such that the retaining member retains aggregate material on the upper surface of the pool drain member.

2. The pool drain member of claim 1, wherein the retaining member extends about an outer perimeter of the upper surface of the pool drain member so as to define a cavity in which the aggregate material can be positioned and wherein the retaining member exerts a force against the aggregate material to retain the aggregate material in the cavity adjacent the upper surface.

3. The pool drain member of claim 2, wherein the retaining member is mounted adjacent the outer perimeter of the upper surface of the drain member so as to extend outward from the plane of upper surface while simultaneously extending inward towards the center of the upper surface such that an outer edge of the retaining member is positioned over the plane of the upper surface.

4. The pool drain member of claim 3, wherein the retaining member is formed of a clear material so that the aggregate material is visible through the retaining member to thereby camouflage the retaining member.

5. The pool drain member of claim 2, further comprising at least one reinforcing member that extends across the cavity defined by the retaining member wherein the at least one reinforcing member is coupled to the inner walls of the retaining member so as to increase the structural rigidity of the retaining member.

6. The pool drain member of claim 5, wherein the retaining member extends outward from the upper surface a first distance and the at least one reinforcing member is recessed in the cavity so as to be located a distance less than the first distance from the upper surface so that when the aggregate material is positioned within the cavity, the aggregate material covers the at least one reinforcing member.

7. The pool drain member of claim 1, wherein the retaining member is attached to the pool drain member through the use of fasteners.

8. The pool drain member of claim 7, wherein the retaining member is attached to the pool drain member through the use of screws.

9. A pool drain assembly for a drain in a pool, the assembly comprising:

a base member defining an opening, wherein the base member is dimensioned so as to be positioned within a drain opening of the pool;

a cap member that mounts on the base member wherein the cap member defines at least one drain opening that permits fluid communication between the pool and the opening in the base member and wherein the cap member defines an upper surface such that when the base member is mounted within the drain opening of the pool and the cap member is mounted on the base member the plane of the upper surface of the cap member is elevated above the drain opening and is positioned within a plane that is generally parallel to the plane of the drain opening;

aggregate material that is positioned on the upper surface of the cap member; and a retainer positioned adjacent the upper surface of the cap member wherein the retainer retains the aggregate material positioned on the upper surface of the cap member.

10. The assembly of claim 9, wherein the aggregate material is selected to match the appearance of the pool bottom in which the pool drain is formed.

11. The assembly of claim 10, wherein the retainer is mounted about an outer perimeter of the upper surface of the cap member so as to define a cavity into which the aggregate material can be positioned.

12. The assembly of claim 11, wherein the retainer exerts an inward force against the aggregate material thereby retaining the aggregate material adjacent the upper surface of the cap member.

13. The assembly of claim 11, wherein the retainer extends outward away from the plane of the upper surface of the cap member.

14. The assembly of claim 12, wherein the retainer extends outward away from the plane of the upper surface of the cap member at an angle less than 90 degrees such that an outer edge of the retainer is positioned over the upper surface of the cap member.

15. The assembly of claim 14, wherein the aggregate material is positioned within the cavity so as to be in contact with the upper surface of the cap member and the inner surfaces of the retainer.

16. The pool drain member of claim 9, wherein the retainer is formed of a clear material so that the aggregate material is visible through the retainer to thereby camouflage the retaining member.

17. The pool drain member of claim 9, further comprising at least one reinforcing member that extends across the cavity defined by the retainer wherein the at least one reinforcing member is coupled to the inner walls of the retainer so as to increase the structural rigidity of the retaining member.

18. The pool drain member of claim 17, wherein the retainer extends outward from the upper surface of the cap member a first distance and the at least one reinforcing member is recessed in the cavity so as to be located a distance less than the first distance from the upper surface of the cap member so that when the aggregate material is positioned within the cavity, the aggregate material covers the at least one reinforcing member.

19. The pool drain member of claim 9, wherein the retainer is attached to the pool drain member through the use of fasteners.

20. The pool drain member of claim 19, wherein the retaining member is attached to the pool drain member through the use of screws.

* * * * *